US010840632B2

(12) United States Patent
Ogawa et al.

(10) Patent No.: US 10,840,632 B2
(45) Date of Patent: Nov. 17, 2020

(54) GROMMET WITH DEFORMABLE SEAL

(71) Applicant: YAZAKI CORPORATION, Tokyo (JP)

(72) Inventors: Masayoshi Ogawa, Aichi (JP); Satoshi Yokoyama, Aichi (JP); Shinichi Ikeda, Aichi (JP); Akitoshi Kimura, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/525,256

(22) Filed: Jul. 29, 2019

(65) Prior Publication Data

US 2020/0076117 A1 Mar. 5, 2020

(30) Foreign Application Priority Data

Aug. 30, 2018 (JP) ..... 2018-161959

(51) Int. Cl.
*H01R 13/52* (2006.01)
*H01R 13/74* (2006.01)

(52) U.S. Cl.
CPC ..... *H01R 13/5205* (2013.01); *H01R 13/74* (2013.01)

(58) Field of Classification Search
CPC ..... H01R 13/5205; H01R 13/74
USPC ..... 439/559
See application file for complete search history.

(56) References Cited

U.S. PATENT DOCUMENTS 3,941,444 A * 3/1976 Bruni ..... H01R 13/5202 439/587
5,044,986 A * 9/1991 Baumanis ..... H01R 13/5202 439/548
5,249,982 A * 10/1993 Funck ..... H01R 13/743 439/556
5,545,061 A * 8/1996 Sawayanagi ..... H01R 13/743 439/556
5,775,944 A * 7/1998 Flask ..... H01R 13/743 439/556

(Continued)

FOREIGN PATENT DOCUMENTS

JP 9-63385 A 3/1997
JP 2014-212585 A 11/2014

(Continued)

*Primary Examiner* — Abdullah A Riyami
*Assistant Examiner* — Vladimir Imas
(74) *Attorney, Agent, or Firm* — Kenealy Vaidya LLP

(57) ABSTRACT

A panel mounting portion of a grommet includes an annular shaped base portion, a seal portion formed on the base portion, and a groove portion formed between the base portion and the seal portion. The seal portion includes a support portion extending forward from the base portion in a mounting direction to the panel, an extension portion extending outward from the support portion in a radial direction, a lip portion formed on the extension portion such that the lip portion protrudes forward in the mounting direction, and a thin portion formed at a middle portion of the support portion in the mounting direction. The panel mounting portion is pressed against the panel, so that the support portion is elastically deformed at the thin portion. And, the lip portion is in close contact with the panel in a state of protruding forward in the mounting direction.

7 Claims, 9 Drawing Sheets

(56) References Cited

U.S. PATENT DOCUMENTS

| | | | | |
|---|---|---|---|---|
| 6,183,275 | B1 * | 2/2001 | Okura | H01R 13/62933 439/157 |
| 6,600,105 | B2 * | 7/2003 | Nakata | H01R 13/743 16/2.1 |
| 6,685,496 | B2 * | 2/2004 | Ookura | H01R 13/5202 439/372 |
| 7,332,678 | B2 * | 2/2008 | Pyron | B60R 16/0222 174/660 |
| 7,607,940 | B2 * | 10/2009 | Ikeya | H01R 13/6215 439/559 |
| 9,130,298 | B1 * | 9/2015 | Baydoun | H01R 13/516 |
| 9,774,129 | B2 * | 9/2017 | Kikuchi | H01R 13/5202 |
| 10,355,412 | B2 * | 7/2019 | Matsuura | H01R 13/6272 |
| 2002/0189838 | A1 * | 12/2002 | Nakata | H01R 13/743 174/653 |
| 2004/0242063 | A1 * | 12/2004 | Miyamoto | H01R 13/743 439/557 |

FOREIGN PATENT DOCUMENTS

| | | | |
|---|---|---|---|
| JP | 2017-118742 | A | 6/2017 |
| JP | 2018-46683 | A | 3/2018 |
| JP | 2018-78727 | A | 5/2018 |

* cited by examiner

GROMMET WITH DEFORMABLE SEAL

CROSS-REFERENCE TO RELATED APPLICATIONS

This application is based on and claims priority under 35 USC 119 from Japanese Patent Application No. 2018-161959 filed on Aug. 30, 2018, the contents of which are incorporated herein by reference.

TECHNICAL FIELD

The present disclosure relates to a grommet.

BACKGROUND ART

For example, a wire harness routed between a vehicle body and a back door of a vehicle passes through a flexible grommet, and thus a waterproof property of the wire harness is ensured while being protected. The grommet is mounted on a panel of the vehicle and includes a seal portion which is in close contact with a surface of the panel (See, for example, JP H09-63385 A, JP 2014-212585 A, JP 2017-118742 A, and JP 2018-046683 A).

In order to improve the sealing property of the seal portion, it is necessary to increase a surface pressure of the seal portion which is in close contact with the panel. Therefore, it is considered to form a plurality of reinforcing ribs between a base portion and the seal portion of a panel mounting portion, in which the seal portion is formed, along a mounting direction to the panel at intervals in a peripheral direction so as to perform reinforcing. However, when the seal portion is reinforced by the reinforcing ribs, the seal portion is not elastically deformed easily. As a result, a large force is required for mounting to the panel, and the mounting operability is reduced.

SUMMARY OF INVENTION

In view of the above-described circumstance, the present disclosure is to provide a grommet by which an excellent sealing property can be obtained while securing good operability in mounting to the panel.

According to an aspects of the present invention, it is possible to provide a grommet by which an excellent sealing property can be obtained while securing good operability in mounting to the panel.

The aspects of the present invention has been briefly described as above. Details of the aspects of the present invention is further clarified by reading a mode (hereinafter, referred to as "embodiment") for carrying out the invention described below with reference to attached drawings.

BRIEF DESCRIPTION OF DRAWINGS

FIG. 2A is a side view of the panel mounting portion, and FIG. 2B is a front view of the panel mounting portion.

FIG. 5A is a cross-sectional view of the seal portion before being mounted, and FIG. 5B is a cross-sectional view of the seal portion after being mounted. The term "change" is, for example, intended to mean a deformation state of the seal portion.

FIGS. 6A and 6B are views illustrating a state where the panel mounting portion of the grommet is mounted obliquely to the panel and. FIG. 6A and FIG. 6B are side views of the panel mounting portion when the panel is viewed in cross section.

FIG. 8A is a cross-sectional view of the seal portion before being mounted, and FIG. 8B is a cross-sectional view of the seal portion after being mounted.

FIG. 9A is a cross-sectional view of the seal portion before being mounted, and FIG. 9B is a cross-sectional view of the seal portion after being mounted.

DESCRIPTION OF EMBODIMENTS

Hereinafter, embodiments according to the present invention will be described with reference to the drawings.

Figure 1:
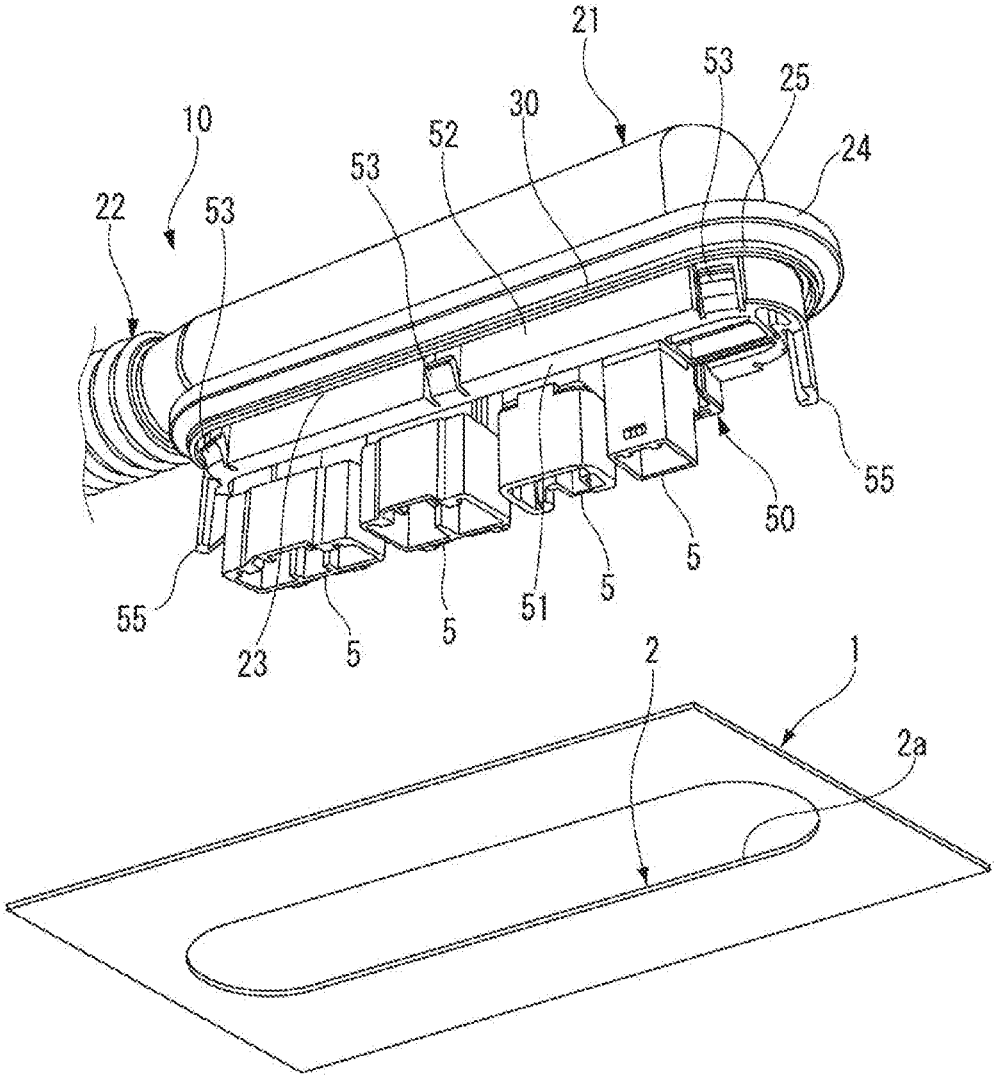
FIG. 1 is a perspective view of a panel mounting portion of a grommet according to the present embodiment.
Figure 2B:
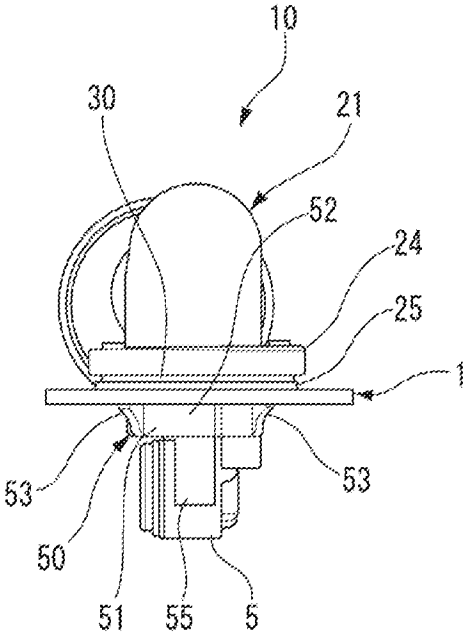
FIGS. 2A and 2B are views illustrating the grommet according to the present embodiment.
Figure 2A:
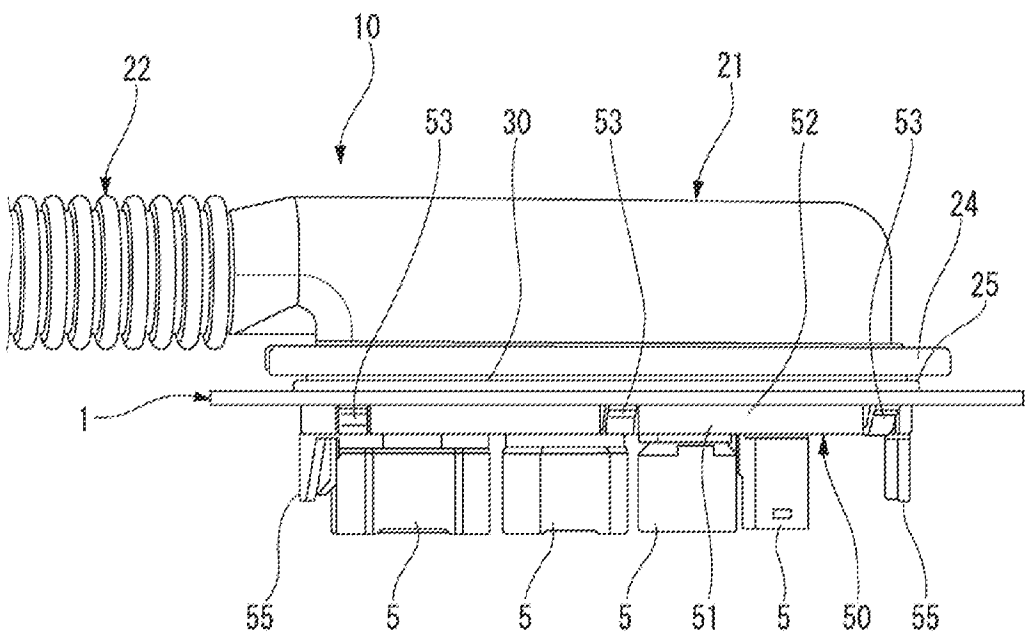
Figure 3:
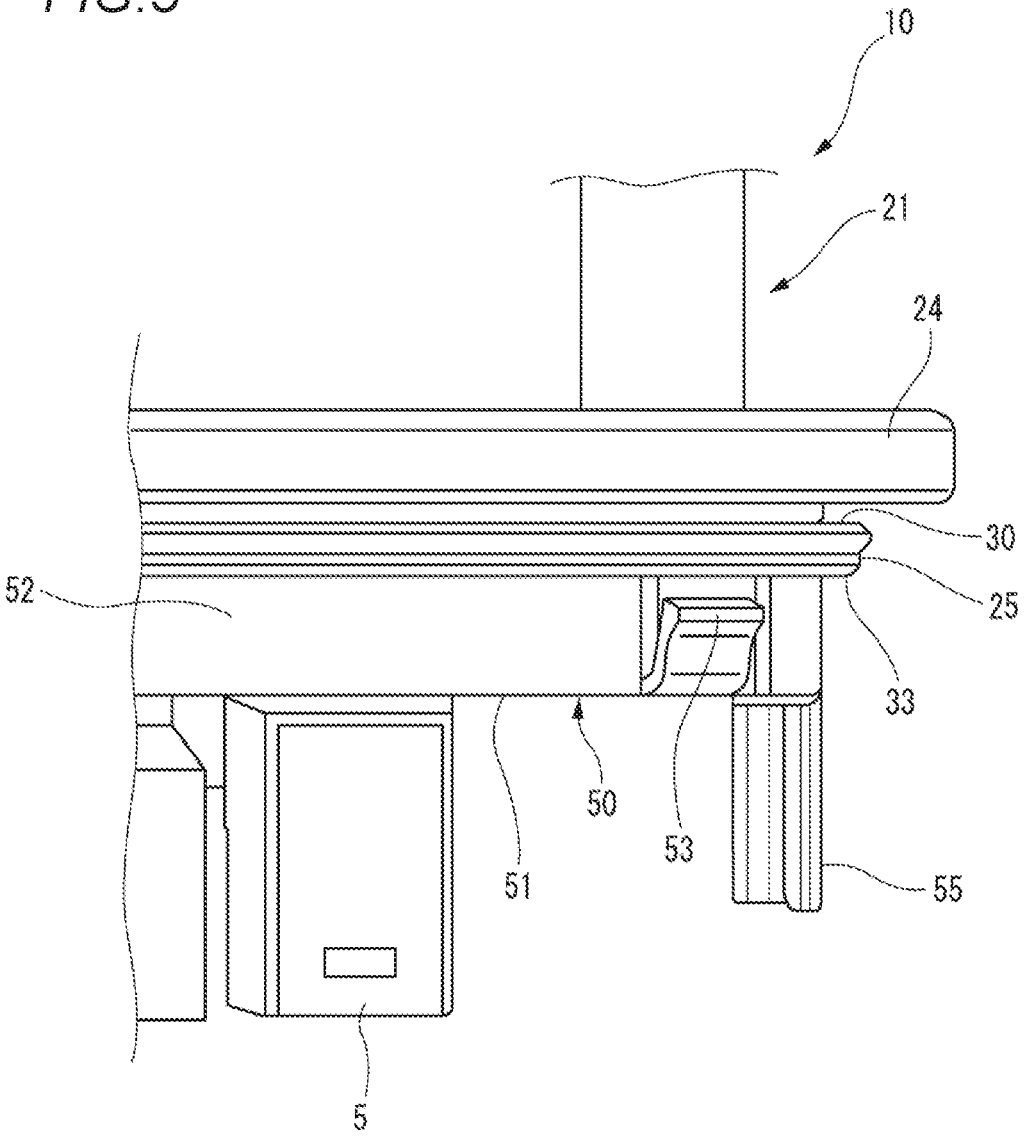
FIG. 3 is a side view of a part of the panel mounting portion of the grommet.

FIG. 1 is a perspective view of a panel mounting portion of a grommet according to the present embodiment. FIGS. 2A and 2B are views illustrating the grommet according to the present embodiment. FIG. 2A is a side view of the panel mounting portion, and FIG. 2B is a front view of the panel mounting portion. FIG. 3 is a side view of a part of the panel mounting portion of the grommet.

As illustrated in FIG. 1 to FIG. 3, a grommet 10 according to the present embodiment includes an inner member 50. The grommet 10 is fitted in and assembled to an attachment hole 2 formed in a panel 1. The grommet 10 is, for example, assembled on a wire harness routed between a vehicle body and a back door in a vehicle to protect and waterproof the wire harness.

The grommet 10 is integrally formed of elastic material which is made of a rubber or the like, and includes a panel mounting portion 21 and a wire insertion portion 22. The panel mounting portion 21 is formed in an elongated shape. The panel mounting portion 21 is formed in a recessed shape having an oval-shaped opening portion 23. The wire insertion portion 22 is formed in a tube shape, and is consecutively installed to one end side of the panel mounting portion 21. The panel mounting portion 21 has an annular base portion 24 at the opening portion 23, and a seal portion 25 is formed on the base portion 24 on a mounting side to the panel 1.

The inner member 50 is integrally molded from a synthetic resin which is made of a plastic or the like. The inner member 50 is formed in an elongated shape, and is fitted and secured to the panel mounting portion 21 from the opening portion 23. In the inner member 50, a portion protruding from the opening portion 23 of the panel mounting portion 21 is a fitting portion 51 having an outer diameter slightly smaller than an inner diameter of the attachment hole 2 of the panel 1, and the fitting portion 51 is fitted into the attachment hole 2. The inner member 50 includes a plurality of locking claws 53 on a peripheral surface 52 of the fitting portion 51. These locking claws 53 lock an edge portion 2*a* of the attachment hole 2 when the fitting portion 51 is fitted into the attachment hole 2.

The inner member 50 includes bar-shaped restriction pieces 55 at both ends in a longitudinal direction thereof. These restriction pieces 55 are formed on the fitting portion 51 of the inner member 50 on the mounting side to the panel 1, and each of the restriction pieces 55 protrudes forward in a mounting direction A.

Wires (not illustrated) of a wire harness to which the grommet 10 is assembled are inserted through the wire insertion portion 22. Further, connectors 5 connected to an end of each of the wires of the wire harness are secured to the inner member 50. Mating connectors are fitted and connected to these connectors 5.

Figure 4:
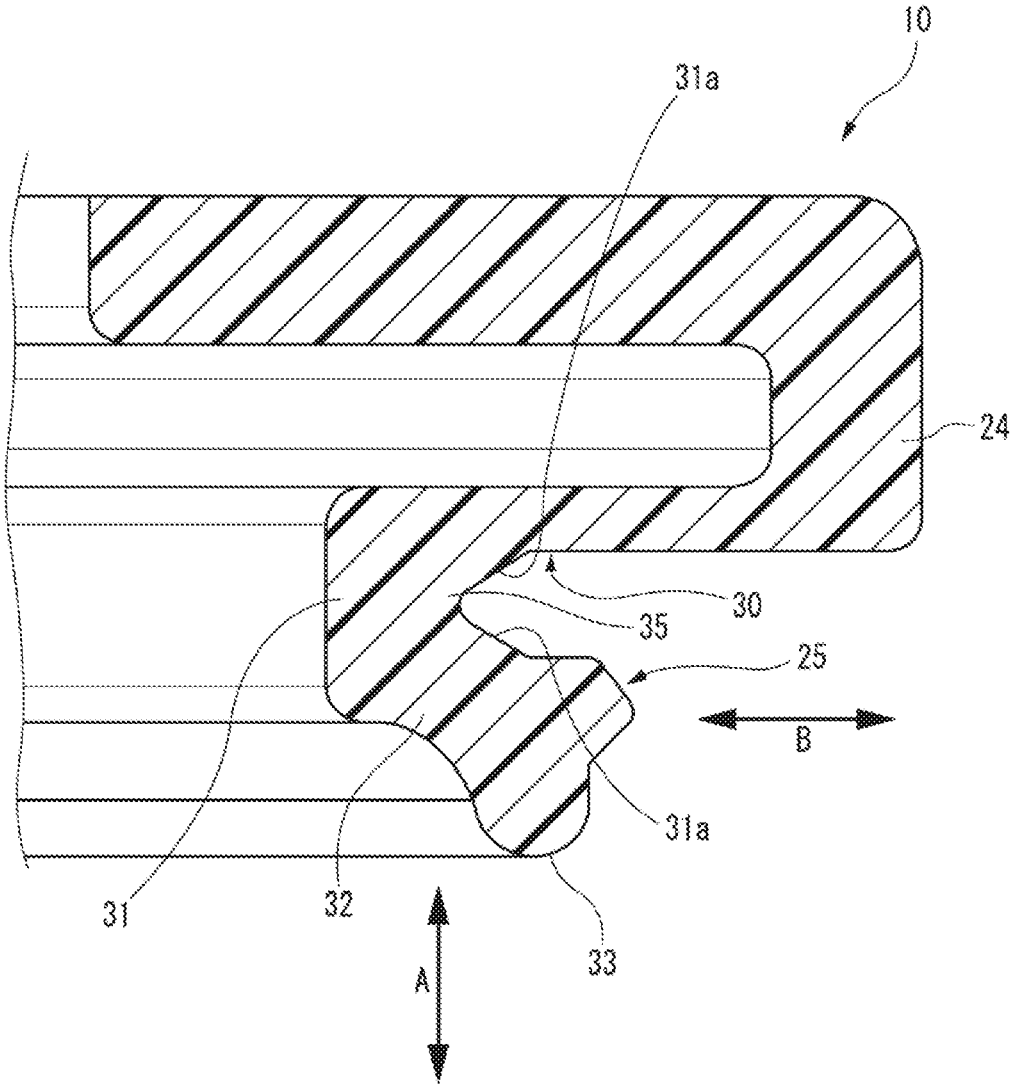
FIG. 4 is a cross-sectional view of the seal portion of the panel mounting portion of the grommet taken along a mounting direction thereof.

FIG. 4 is a cross-sectional view illustrating the seal portion of the panel mounting portion of the grommet taken along the mounting direction thereof.

As illustrated in FIG. 4, the seal portion 25 formed on the panel mounting portion 21 is formed on the mounting side of the base portion 24 with respect to the panel 1. A groove portion 30 continuous in a peripheral direction of the grommet (continuously provided in the peripheral direction) is formed between the base portion 24 and the seal portion 25. The groove portion 30 is provided outward on the panel mounting portion 21 in a radial direction of the grommet and is formed over the entire periphery.

The seal portion 25 includes a support portion 31, an extension portion 32 and a lip portion 33. The support portion 31 extends forward from the base portion 24 in the mounting direction A to the panel 1. The extension portion 31 extends outward in a radial direction B perpendicular to the mounting direction A from the support portion 31. The lip portion 33 protrudes forward in the mounting direction A from the extension portion 32. The extension portion 32 may extend in a direction intersecting with respect to the mounting direction A, and may not necessarily extend in a direction perpendicular to the support portion 31.

The support portion 31 includes a thin portion 35. The thin portion 35 is formed at a middle portion of the support portion 31 in the mounting direction A. The support portion 31 includes tapered portions 31*a* on a groove portion 30. The tapered portion 31*a* is formed in a tapered shape which is inclined outward in the radial direction as being away from the thin portion 35. Accordingly, the support portion 31 is formed in a shape to be narrowed at the thin portion 35, and a thickness thereof is gradually increased outward in the radial direction as the support portion is positioned toward a side of the base portion 24 and a side of the extension portion 32 with respect to the thin portion 35.

Next, a case where the grommet 10 described above is to be attached to the panel 1 will be described.

Figure 5A:
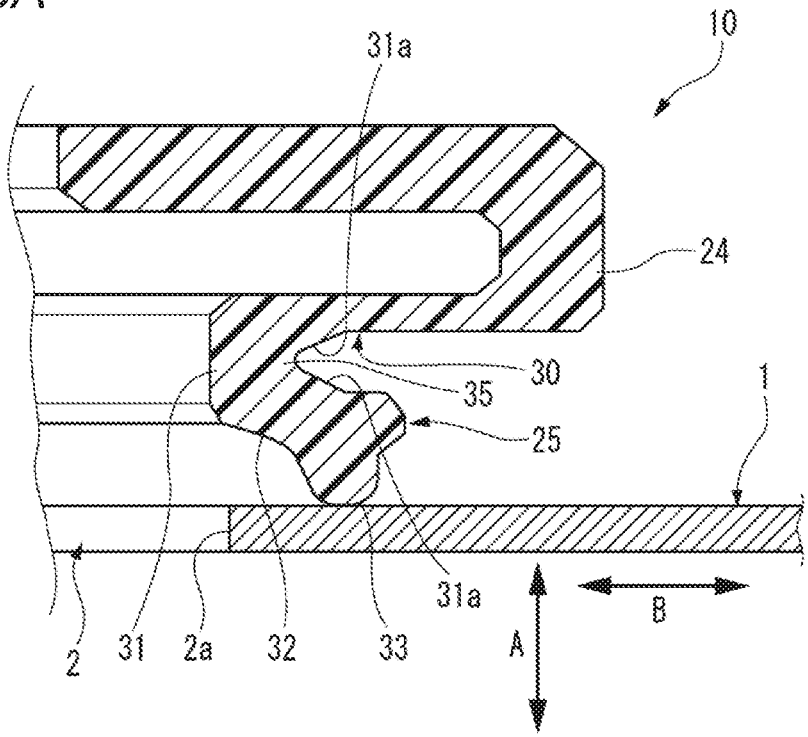
FIGS. 5A and 5B are views illustrating a change of the seal portion when the panel mounting portion of the grommet is mounted to a panel.
Figure 5B:
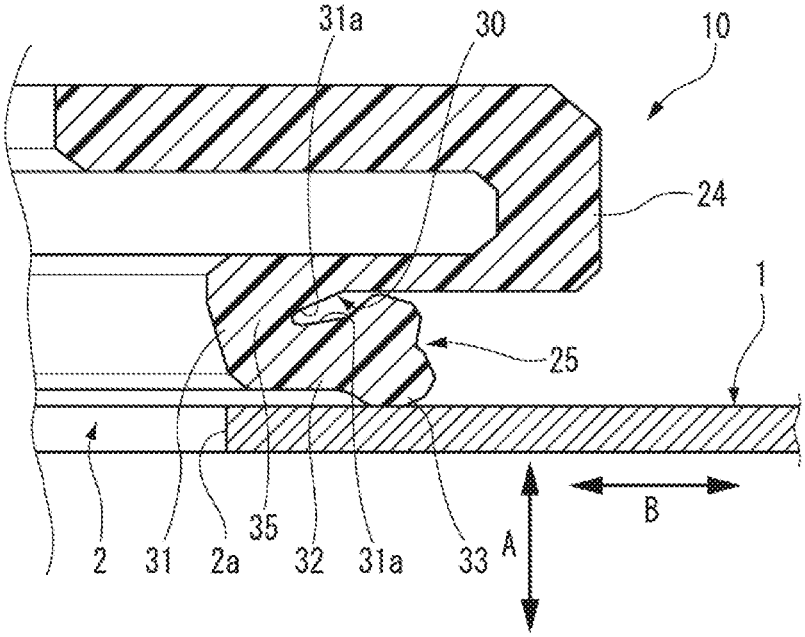

FIGS. 5A and 5B are views illustrating a change of the seal portion when the panel mounting portion of the grommet is mounted to the panel. FIG. 5A is a cross-sectional view of the seal portion before being mounted, and FIG. 5B is a cross-sectional view of the seal portion after being mounted.

In order to mount the grommet 10 to the panel 1, the panel mounting portion 21 of the grommet 10 is brought close to the panel 1, and the fitting portion 51 of the inner member 50 is inserted into the attachment hole 2. Then, as illustrated in FIG. 5A, the lip portion 33 of the seal portion 25 of the panel mounting portion 21 is abutted on a surface of the panel 1.

The panel mounting portion 21 of the grommet 10 is pushed into a panel 1 side from this state. Then, the support portion 31 in the seal portion 25 is bent and crushed at the thin portion 35 formed at the middle portion of the seal portion 25 in the mounting direction A so as to be elastically deformed. For example, the wording "the support portion 31 in the seal portion 25 is bent and crushed at the thin portion 35 is intended to mean that an angle defined between the tapered portions 31*a* before being elastically deformed is larger than an angle defined between the tapered portions 31*a* after being elastically deformed". Accordingly, the lip portion 33 moves along the mounting direction A while being abutted with the panel 1.

Further, when the panel mounting portion 21 is pushed to the panel 1, the locking claws 53 of the fitting portion 51 of the inner member 50 lock the edge portion 2*a* of the attachment hole 2 of the panel 1. Accordingly, the panel mounting portion 21 of the grommet 10 is mounted to the panel 1.

In a state where the panel mounting portion 21 is assembled to the panel 1, as illustrated in FIG. 5B, the lip portion 33 of the seal portion 25 is pressed against the surface of the panel 1 while keeping the state of protruding forward in the mounting direction A, and is brought into close contact with the panel 1 with a large surface pressure. Accordingly, a mounting portion of the grommet 10 with respect to the panel 1 is sealed by the seal portion 25.

As described above, according to the grommet 10 of the present embodiment, since the groove portion 30 which is continuous in the peripheral direction is provided outward, in the radial direction, between the base portion 24 and the seal portion 25 of the panel mounting portion 21, the seal portion 25 is easily elastically deformed when the panel mounting portion 21 is mounted to the panel 1. Therefore, the operability in mounting to the panel 1 can be improved.

Moreover, the support portion 31 of the seal portion 25 is bent and crushed at the thin portion 35 formed at the middle portion in the mounting direction A so as to be elastically deformed, so that the lip portion 33 moves along the mounting direction A while being abutted with the panel 1 without falling down. Therefore, the lip portion 33 is pressed against the panel 1 with a large surface pressure, and is brought into close contact with the panel 1 with a large contact area, so that a good sealing property can be obtained.

Since the thin portion 35 formed at the middle portion of the support portion 31 in the mounting direction A has a simple shape, the manufacturing cost can be reduced.

The thickness of the support portion 31 is gradually increased outward as the support portion is positioned toward the side of the base portion 24 and the side of the extension portion 32 with respect to the thin portion 35. Therefore, the panel mounting portion 21 is pressed against the panel 1, so that the support portion 31 can be bent and crushed smoothly at the middle portion in the mounting direction A so as to be elastically deformed.

The support portion 31 includes the tapered portions 31*a*. Each of the tapered portions 31*a* is inclined outward in the radial direction as being away from the thin portion 35. That is, the support portion 31 is formed in the shape such that a thickness thereof is gradually increased outward as the support portion is positioned toward the side of the base portion 24 and the side of the extension portion 32 with respect to the thin portion 35. Therefore, deterioration of the support portion 31 in the radial direction in a state where the panel mounting portion 21 is pressed against the panel 1 can be reduced, and the good sealing property obtained by the lip portion 33 can be maintained.

Figure 6A:
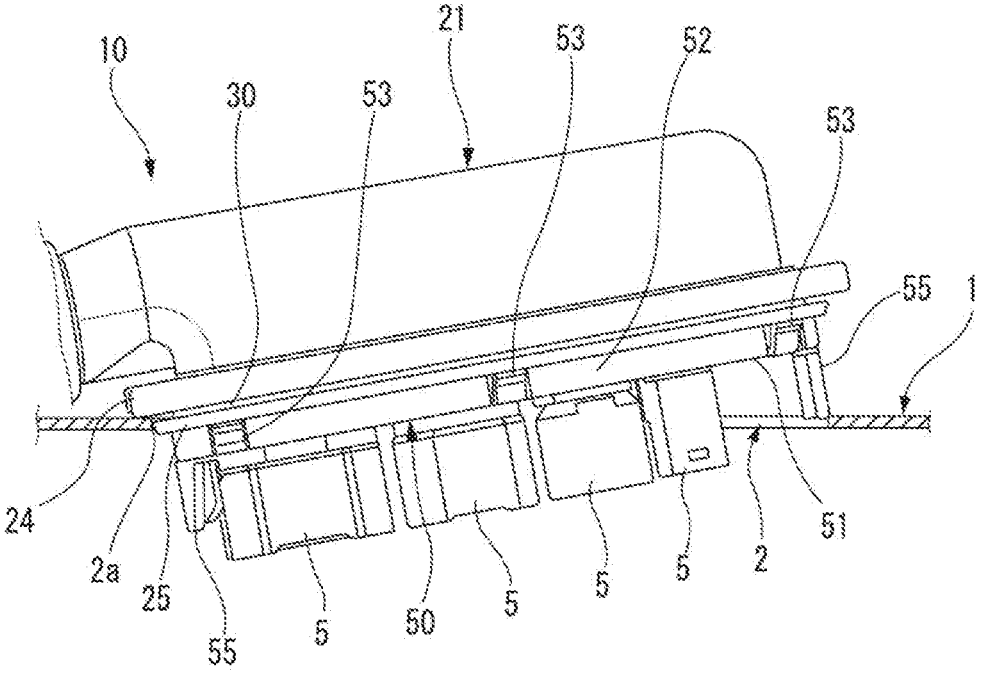
Figure 6B:
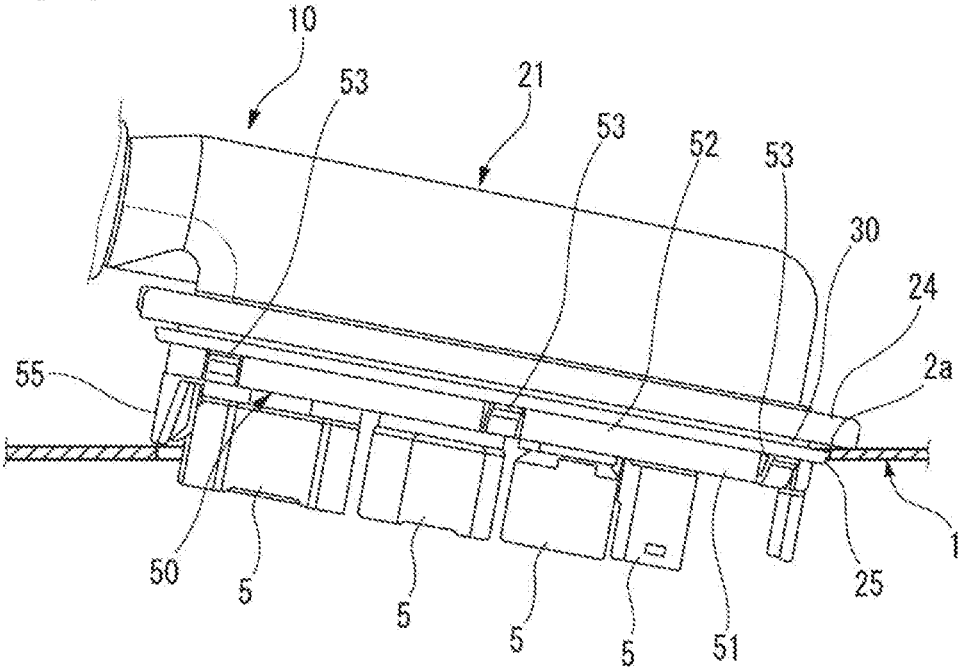

As illustrated in FIG. 6A and FIG. 6B, when the grommet 10 is mounted on the panel 1, if the panel mounting portion 21 of the grommet 10 is inclined with respect to the panel 1, the edge portion 2*a* of the attachment hole 2 of the panel 1 may enter the groove portion 30, so that the seal portion 25 may be stuck. Further, if the panel mounting portion 21 of the grommet 10 is pushed by forced in this state, the seal portion 25 may be damaged by the edge portion 2*a* of the attachment hole 2, and the sealing property of the seal portion 25 may be reduced.

However, in the grommet 10 according to the present embodiment, when the inner member 50 is fitted obliquely into the attachment hole 2 of the panel 1, the restriction piece 55 of the inner member 50 is abutted on the edge portion 2*a* of the attachment hole 2. More specifically, when one end portion of the inner member 50 in the longitudinal direction is fitted into the attachment hole 2 first and the inner member 50 is inclined with respect to the panel 1, the restriction piece 55 provided on the other end portion of the inner member 50 in the longitudinal direction is abutted on the edge portion 2*a* of the attachment hole 2. Accordingly, it is possible to prevent the inner member 50 from being fitted to the attachment hole 2 in a state where the inner member 50 is fitted obliquely into the attachment hole 2 and thus the edge portion 2*a* of the attachment hole 2 enters the groove portion 30. Therefore, damage to the seal portion 25 due to that the seal portion 25 is stuck by the edge portion 2*a* of the attachment hole 2 can be prevented in advance. Accordingly, the good sealing property obtained by the seal portion 25 can be secured.

Next, various reference examples will be described.

Reference Example 1

Figure 7:
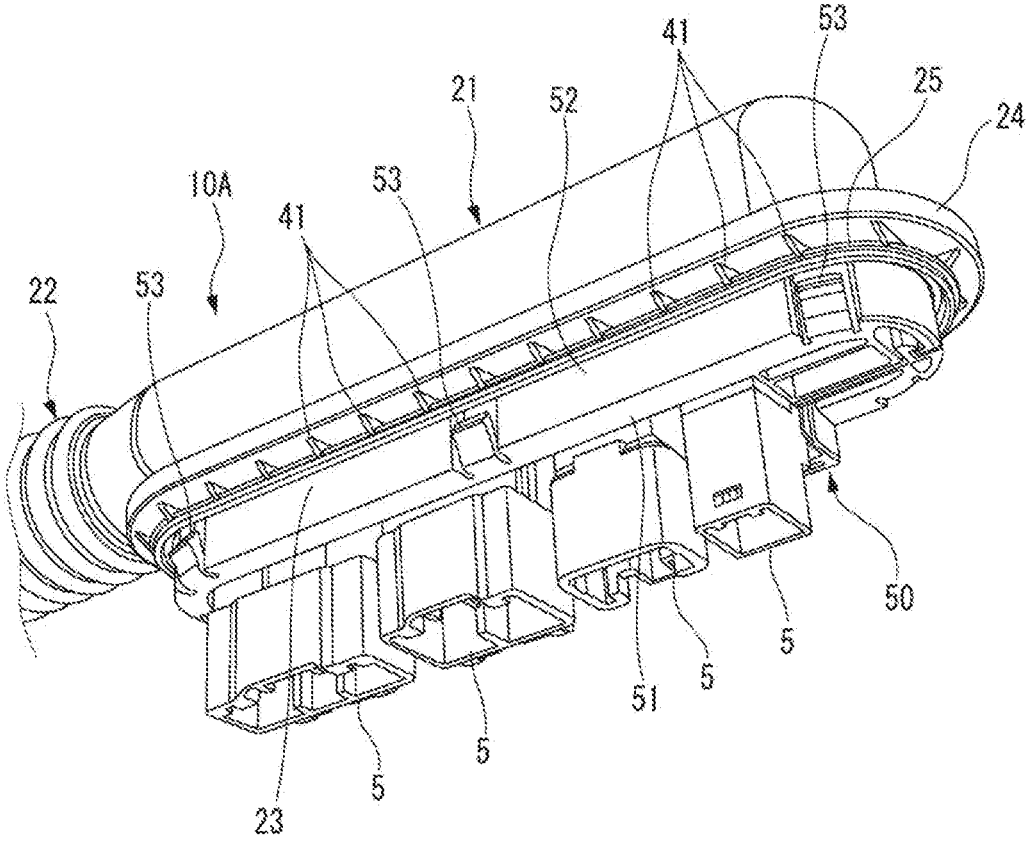
FIG. 7 is a perspective view of a panel mounting portion of a grommet according to reference example 1.

FIG. 7 is a perspective view of a panel mounting portion of a grommet according to reference example 1.

As illustrated in FIG. 7, in a grommet 10A according to reference example 1, a plurality of reinforcing ribs 41 along the mounting direction A are formed between the base portion 24 and the seal portion 25 of the panel mounting portion 21 at intervals in the peripheral direction. According to the grommet 10A, the seal portion 25 is reinforced by the reinforcing ribs 41, so that the surface pressure of the lip portion 33 with respect to the panel 1 can be increased when mounted on the panel 1 and the sealing property can be improved.

However, since the seal portion 25 in the grommet 10A is difficult to be elastically deformed for being reinforced by the reinforcing ribs 41, a large assembling force is required during mounting to the panel 1, and the mounting operability is reduced.

In contrast, according to the grommet 10 of the present embodiment, since the groove portion 30 which is continuous in the peripheral direction is provided outward, in the radial direction, between the base portion 24 and the seal portion 25, the seal portion 25 is easily elastically deformed when the panel mounting portion 21 is mounted to the panel 1. Therefore, the operability in mounting to the panel 1 can be improved.

Moreover, the support portion 31 of the seal portion 25 is bent and crushed at the thin portion 35 formed at the middle portion in the mounting direction A so as to be elastically deformed, so that the lip portion 33 moves along the mounting direction A while being abutted with the panel 1 without falling down. Therefore, even if the seal portion 25 is not reinforced by the reinforcing ribs 41, the lip portion 33 is pressed against the panel 1 with a large surface pressure, and is brought into close contact with the panel 1 with a large contact area, so that a good sealing property can be obtained.

Reference Example 2

Figure 8A:
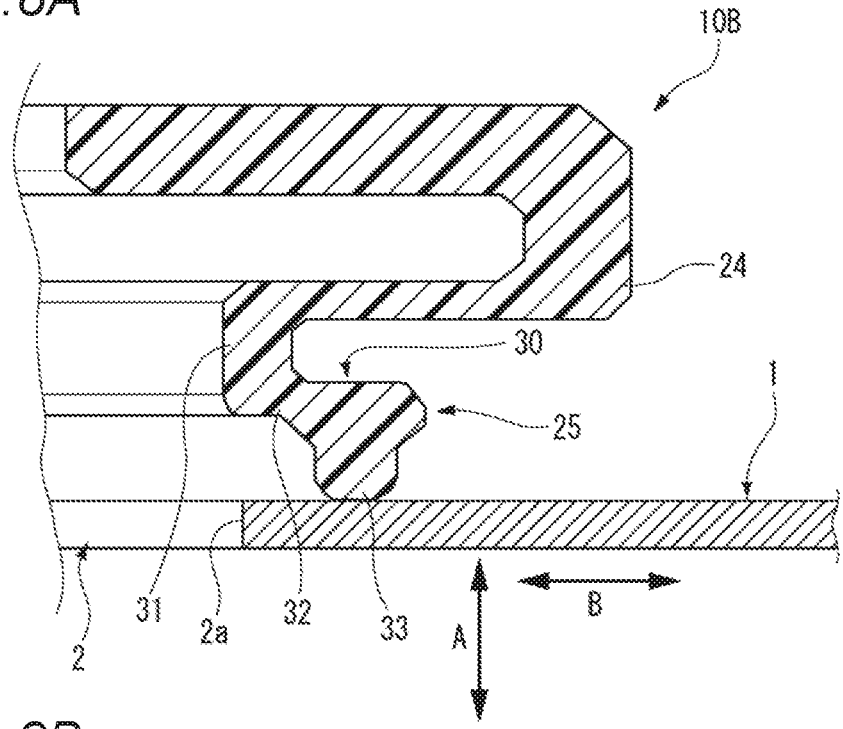
FIGS. 8A and 8B are views illustrating a change of a seal portion when a panel mounting portion of a grommet according to reference example 2 is mounted to a panel.
Figure 8B:
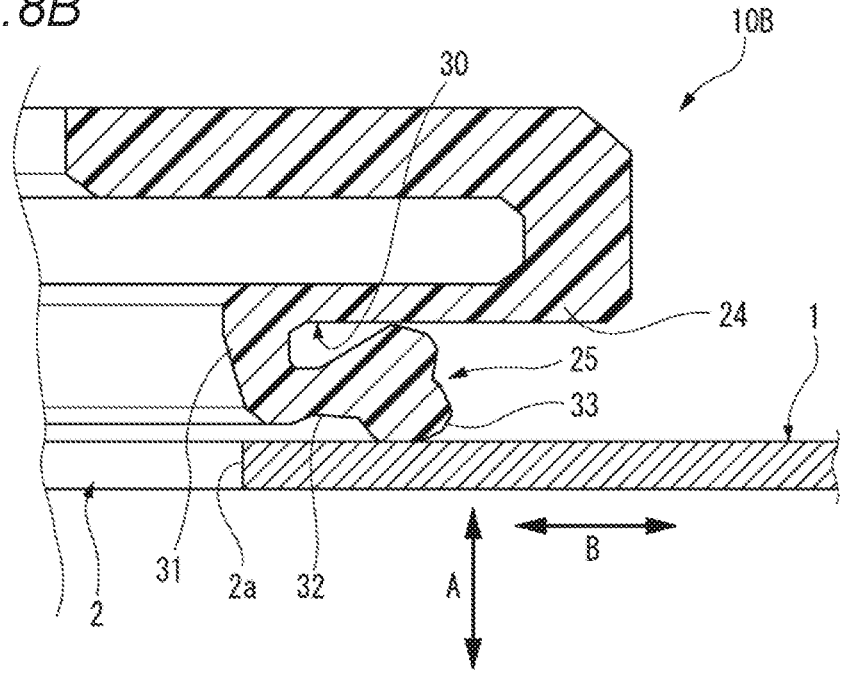

FIGS. 8A and 8B are views illustrating a change of a seal portion when a panel mounting portion of a grommet according to reference example 2 is mounted to a panel. FIG. 8A is a cross-sectional view of the seal portion before being mounted, and FIG. 8B is a cross-sectional view of the seal portion after being mounted.

As illustrated in FIG. 8A, in a grommet 10B according to reference example 2, the support portion 31 of the seal portion 25 does not include the thin portion 35 and has the same thickness along the mounting direction A.

In the grommet 10B, the extension portion 32 is bent at a portion as a fulcrum connecting with the support portion 31 by a bending moment when the lip portion 33 is abutted with the surface of the panel 1. Then, as illustrated in FIG. 8B, the lip portion 33 formed on the extension portion 32 falls down and is largely inclined with respect to the mounting direction A. Therefore, the surface pressure of the lip portion 33 against the panel 1 is reduced, and the sealing property of the seal portion 25 is reduced.

In contrast, according to the grommet 10 of the present embodiment, the support portion 31 of the seal portion 25 is bent and crushed at the thin portion 35 formed in the middle portion in the mounting direction A so as to be elastically deformed, so that the lip portion 33 moves along the mounting direction A while being abutted with the panel 1 without falling down. Therefore, the lip portion 33 is pressed against the panel 1 with a large surface pressure, and is brought into close contact with the panel 1 with a large contact area. Therefore, by providing the groove portion 30, a good sealing property can be ensured while maintaining good mounting operability.

Reference Example 3

Figure 9A:
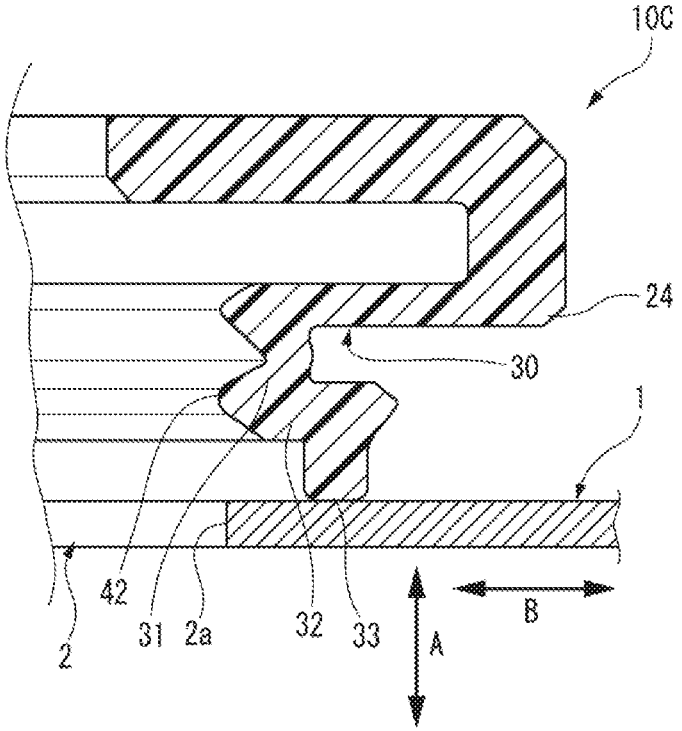
FIGS. 9A and 9B are views illustrating a change of a seal portion when a panel mounting portion of a grommet according to reference example 3 is mounted to a panel.
Figure 9B:
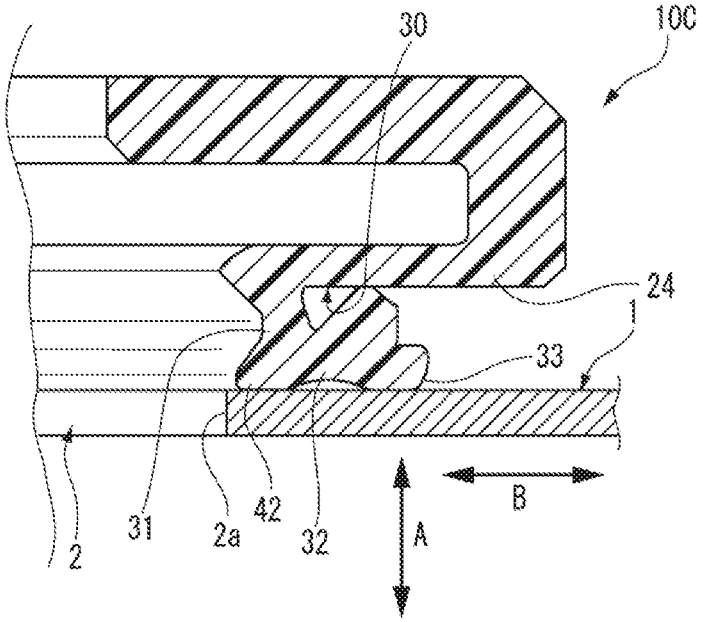

FIGS. 9A and 9B are views illustrating a change of a seal portion when a panel mounting portion of a grommet according to reference example 3 is mounted to a panel. FIG. 9A is a cross-sectional view of the seal portion before being mounted, and FIG. 9B is a cross-sectional view of the seal portion after being mounted.

As illustrated in FIG. 9A, in a grommet 10C according to reference example 3, the seal portion 25 includes a lip portion 42 different from the lip portion 33. The lip portion 42 protrudes in a direction opposite the extending direction of the extension portion 32.

In the grommet 10C, as illustrated in FIG. 9B, the lip portion 33 and the other lip portion 42 are abutted on the surface of the panel 1 when the panel mounting portion 21 is assembled to the panel 1. Accordingly, even if the surface pressure of the lip portions 33, 42 with respect to the panel 1 is small, a good sealing property is obtained by sealing at two places.

However, in the grommet 10C, it is necessary to mold the two lip portions 33, 42 with high dimensional accuracy in order to bring the two lip portions 33, 42 into tightly close contact with the panel 1 in a balanced manner. As a result, the manufacturing cost is increased.

In contrast, according to the grommet 10 of the present embodiment, since the thin portion 35 formed at the middle portion of the support portion 31 in the mounting direction A has a simple shape, a good sealing property can be ensured with one lip portion 33 while reducing the manufacturing cost.

The present disclosure is not limited to the above embodiment, and may be appropriately modified, improved, or the like. In addition, materials, shapes, dimensions, numerals, disposition locations or the like of constituent elements in the above-described embodiment are selectable and not limited as long as the invention can be achieved.

According to an aspect of the present invention, there is provided a grommet which is configured to cover a periphery of a wire harness, the grommet including a panel mounting portion which is configured to be mounted to the panel, in which the panel mounting portion includes, a base portion which is formed in an annular shape, a seal portion which is formed on the base portion and is configured to be in close contact with a surface of the panel, and a groove portion which is formed between the base portion and the seal portion, the groove portion being continuous in a peripheral direction, in which the seal portion includes, a support portion which extends forward from the base portion in a mounting direction to the panel, an extension portion which extends outward from the support portion in the radial direction intersecting with respect to the mounting direction, a lip portion which is formed on the extension portion such that the lip portion protrudes forward in the mounting direction, being configured to be in close contact with the panel, and a thin portion which is formed at a middle portion of the support portion in the mounting direction, in which the panel mounting portion is pressed against the panel, so that the support portion is bent and crushed at the thin portion so as to be elastically deformed, and the lip portion is in close contact with the panel in a state of protruding forward in the mounting direction.

According to an aspect of the present invention, a thickness of the support portion is gradually increased as the support portion is positioned toward a side of the base portion and a side of the extension portion with respect to the thin portion.

According to another aspect of the present invention, the support portion includes tapered portions on the side of the base portion and on the side of the extension portion respectively, each of the tapered portions being inclined outward in the radial direction as being away from the thin portion.

According to the grommet of the aspects of the present invention, since the groove portion which is continuous in the peripheral direction is provided outward, in the radial direction, between the base portion and the seal portion of the panel mounting portion, the seal portion is easily elastically deformed when the panel mounting portion is mounted to the panel. Therefore, the good operability in mounting to the panel can be obtained.

Moreover, the support portion of the seal portion is bent and crushed at the thin portion formed in the middle portion in the mounting direction so as to be elastically deformed, so that the lip portion moves along the mounting direction while being abutted with the panel without falling down. Therefore, even if the seal portion is not reinforced by the ribs, the lip portion is pressed against the panel with a large surface pressure, and is brought into close contact with the panel with a large contact area, so that a good sealing property is obtained.

Since the thin portion formed in the middle portion of the support portion in the mounting direction has a simple shape, the manufacturing cost can be reduced.

According to the grommet of the aspects of the present invention, the panel mounting portion is pressed against the panel, so that the support portion can be bent and crushed smoothly at the middle portion in the mounting direction so as to be elastically deformed.

According to the grommet of the aspects of the present invention, deterioration of the support portion in the radial direction in a state where the panel mounting portion is pressed against the panel can be reduced, and the good sealing property obtained by the lip portion can be maintained.

REFERENCE SIGNS LIST

1 panel
10 grommet
21 panel mounting portion
24 base portion
25 seal portion
30 groove portion
31 support portion
31*a* tapered portion
32 extension portion
33 lip portion
35 thin portion
A mounting direction

What is claimed is:

1. A grommet which is configured to cover a periphery of a wire harness, the grommet comprising:
- a panel mounting portion which is configured to be mounted to a panel,
- wherein the panel mounting portion includes:
  - a base portion which is formed in an annular shape;
  - a seal portion which is formed on the base portion and is configured to be in close contact with a surface of the panel; and
  - a groove portion which is formed between the base portion and the seal portion, the groove portion being continuous in a peripheral direction,
- wherein the seal portion includes:
  - a support portion which extends forward from the base portion in a mounting direction to the panel,
  - an extension portion which extends outward from the support portion in a radial direction intersecting with respect to the mounting direction,
  - a lip portion which is formed on the extension portion such that the lip portion protrudes forward in the mounting direction, being configured to be in close contact with the panel, and
  - a thin portion which is formed at a middle portion of the support portion in the mounting direction,
- wherein the panel mounting portion is pressed against the panel, so that the support portion is bent and crushed at the thin portion so as to be elastically deformed, and
- wherein the lip portion is in close contact with the panel in a state of protruding forward in the mounting direction.

2. The grommet according to claim 1, wherein a thickness of the support portion is gradually increased as the support portion is positioned toward a side of the base portion and a side of the extension portion with respect to the thin portion.

3. The grommet according to claim 2, wherein the support portion includes tapered portions on the side of the base portion and on the side of the extension portion respectively, each of the tapered portions being inclined outward in the radial direction as being away from the thin portion.

4. The grommet according to claim 1, wherein the lip portion is configured to abut the surface of the panel in a state in which the panel mounting portion is mounted to the panel.

5. The grommet according to claim 1, wherein one side of the lip portion is configured to abut the surface of the panel and another side of the lip portion is configured to abut the groove portion in a state in which the panel mounting portion is mounted to the panel.

6. The grommet according to claim 1, wherein the base portion extends further outward in the radial direction than the seal portion in a state in which the panel mounting portion is mounted to the panel.

7. The grommet according to claim 1, wherein the lip portion is configured to move along the mounting direction while being abutted with the panel without falling down in a state in which the panel mounting portion is mounted to the panel.

* * * * *